United States Patent [19]

Peterson

[11] 4,084,854

[45] Apr. 18, 1978

[54] DRAG BIT EXCAVATION

[75] Inventor: Carl R. Peterson, Boxford, Mass.

[73] Assignee: Rapidex, Inc., Burlington, Mass.

[21] Appl. No.: 737,068

[22] Filed: Nov. 1, 1976

[51] Int. Cl.[2] ..... E21C 27/22; E21C 29/24

[52] U.S. Cl. ..... 299/57; 299/78; 299/87; 299/90

[58] Field of Search ..... 175/394, 395; 299/39, 299/78, 68, 87, 56, 57, 23, 18; 37/81, 82; 83/672, 680

[56] References Cited

U.S. PATENT DOCUMENTS

| | | | |
|---|---|---|---|
| 2,417,313 | 3/1947 | MacKinnon | 37/81 |
| 3,039,208 | 6/1962 | Oglesby | 37/81 |
| 3,226,855 | 1/1966 | Smith | 175/394 |
| 3,714,990 | 2/1973 | Tomik | 299/39 |

*Primary Examiner*—Ernest R. Purser
*Assistant Examiner*—William F. Pate, III

[57] ABSTRACT

In a drag bit excavating device having a plurality of cutting elements, each element comprising a core extending along an axis; a bit carrier supported on the core; cutter bits supported by the carrier along a three dimensional spiral having constant pitch and increasing radius along at least a portion of the axis, the carrier being relieved to provide radially extending spaces between the turns of the spiral; a frame supporting the core, carrier, and bits for rotation about and advance along the axis; and a drive to provide rotation, whereby bits slot the material to be excavated while the material between portions of the resulting slot extends into the spaces to be subsequently broken away; support means for supporting the elements in an array sloping along a plane with their respective axes parallel to each other, the plane sloping in a direction transverse to the axes, the axes being spaced along the plane in the direction of slope, the elements having their drives arranged so that each core, carrier, and bit assembly rotates clockwise when viewed along its axis with the plane sloping upwardly to the right.

3 Claims, 11 Drawing Figures

FIG 4
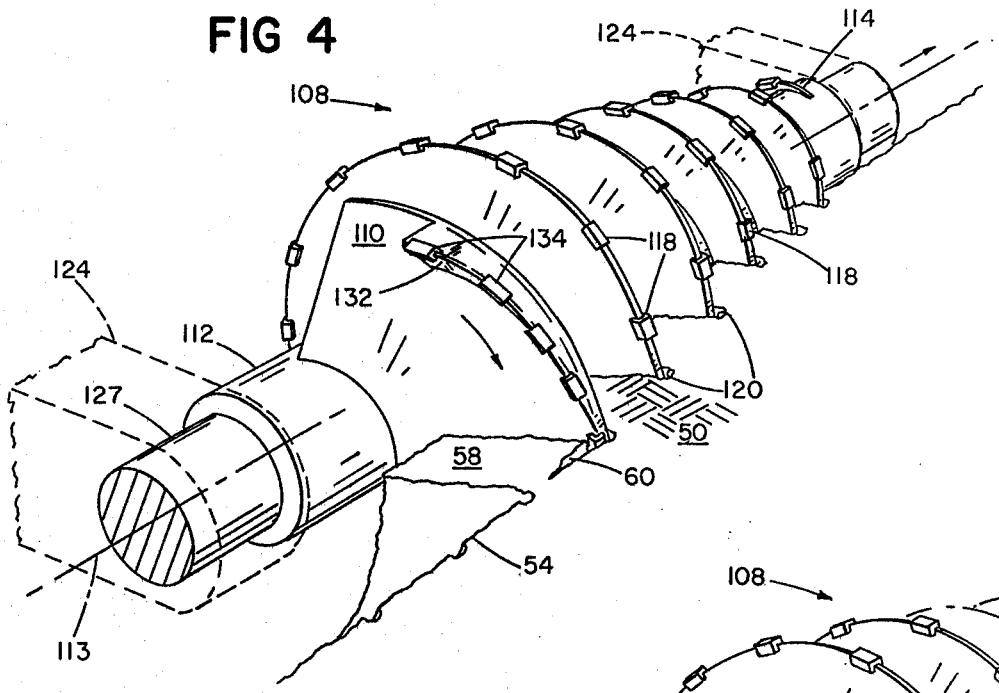
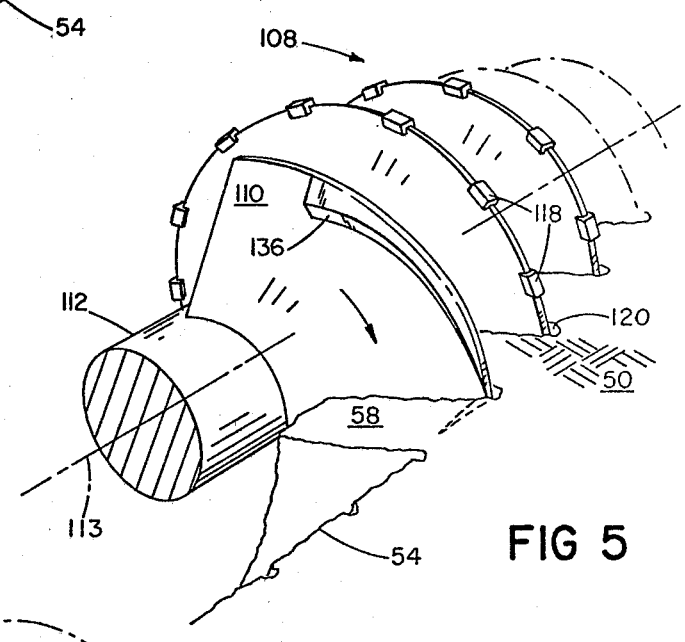
FIG 5
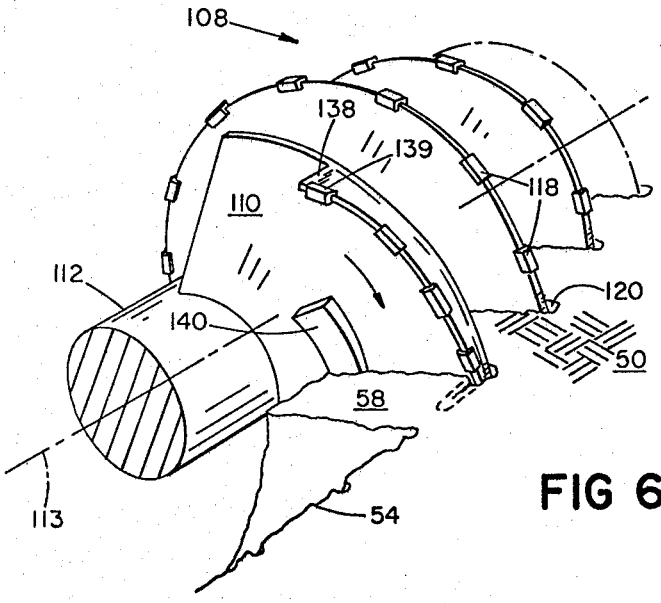
FIG 6

FIG 7
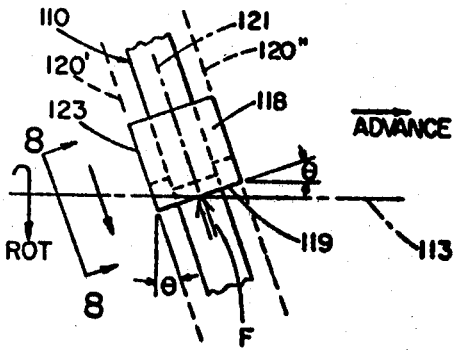
FIG 8
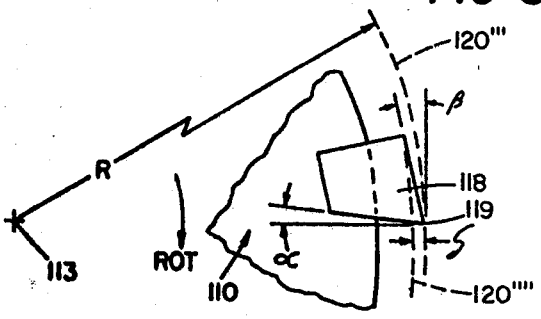
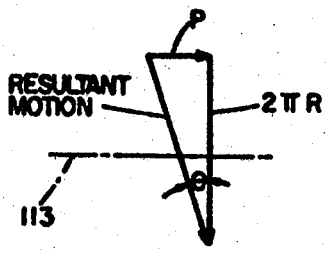
FIG 7a
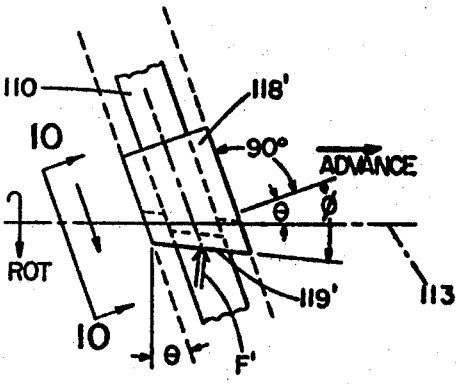
FIG 9
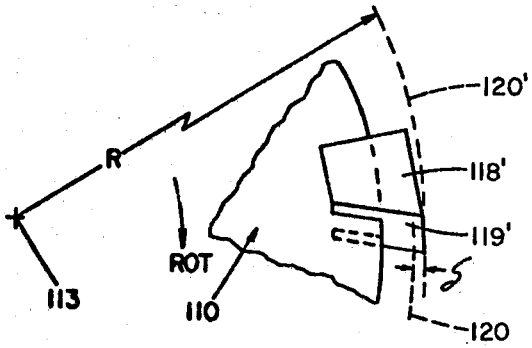
FIG 10

DRAG BIT EXCAVATION

BACKGROUND OF THE INVENTION

This invention relates to excavating on an exposed, sloping face of a mineral (e.g., coal) to be mined.

The invention involves use of excavating elements disclosed in a U.S. Patent Application entitled "Drag Bit Excavation" executed on Oct. 27, 1976 by Carl R. Peterson and Allan T. Fisk, the disclosure of said application being incorporated herein by reference.

SUMMARY OF THE INVENTION

The invention makes possible high productivity strip mining with simple, compact machinery. Power requirements are low. The machinery can be accomodated to seams of different thicknesses, and even to variation in seam thicknesses along the length of a single pit. Even curved pit plans can be accomodated.

The invention employes cutting elements of the type disclosed in said Peterson and Fisk application, each comprising a core extending along an axis, a bit carrier supported on the core, cutter bits supported by the carrier along a three dimensional spiral having constant pitch and increasing radius along at least a portion of the axis, the carrier being relieved to provide radially extending spaces between the turns of the spiral, a frame supporting the core, carrier, and bits for rotation about and advance along the axis, and a drive to provide rotation, whereby the bits slot the material to be excavated while the material between portions of the resulting slot extends into the spaces to be subsequently broken away. The invention features support means for supporting the elements in an array sloping along a plane with their respective axes parallel to each other, the plane sloping in a direction transverse to the axes, the axes being spaced along the plane in the direction of slope, the elements having their drives arranged so that each core, carrier, and bit assembly rotates clockwise when viewed along its axis with the plane sloping upwardly toward the right. In preferred embodiments the elements are staggered along the direction of the axes so that cuttings produced by one element do not drop on another element; and upper and lower support vehicles are provided at the upper and lower ends of the support means.

Other advantages and features of the invention will be apparent from the description and drawings herein of a preferred embodiment thereof.

BRIEF DESCRIPTION OF THE DRAWINGS

FIG. 4 is a perspective view of the embodiment of FIG. 1;

FIG. 5 is a fragmentary view similar to a portion of FIG. 4 but showing another embodiment;

FIG. 6 is a view similar to FIG. 5 showing yet another embodiment;

FIG. 7 is a detailed view of an individual cutter bit and the adjacent portion of the carrying web, looking radially inwardly;

FIG. *7a* is a development of the motion of a single tooth during revolution of the spiral saw;

FIG. 8 is a side view of the tooth of FIG. 7;

FIGS. 9–10 correspond respectively to FIGS. 7–8 and show another embodiment.

DESCRIPTION OF THE PREFERRED EMBODIMENT

Figure 1:
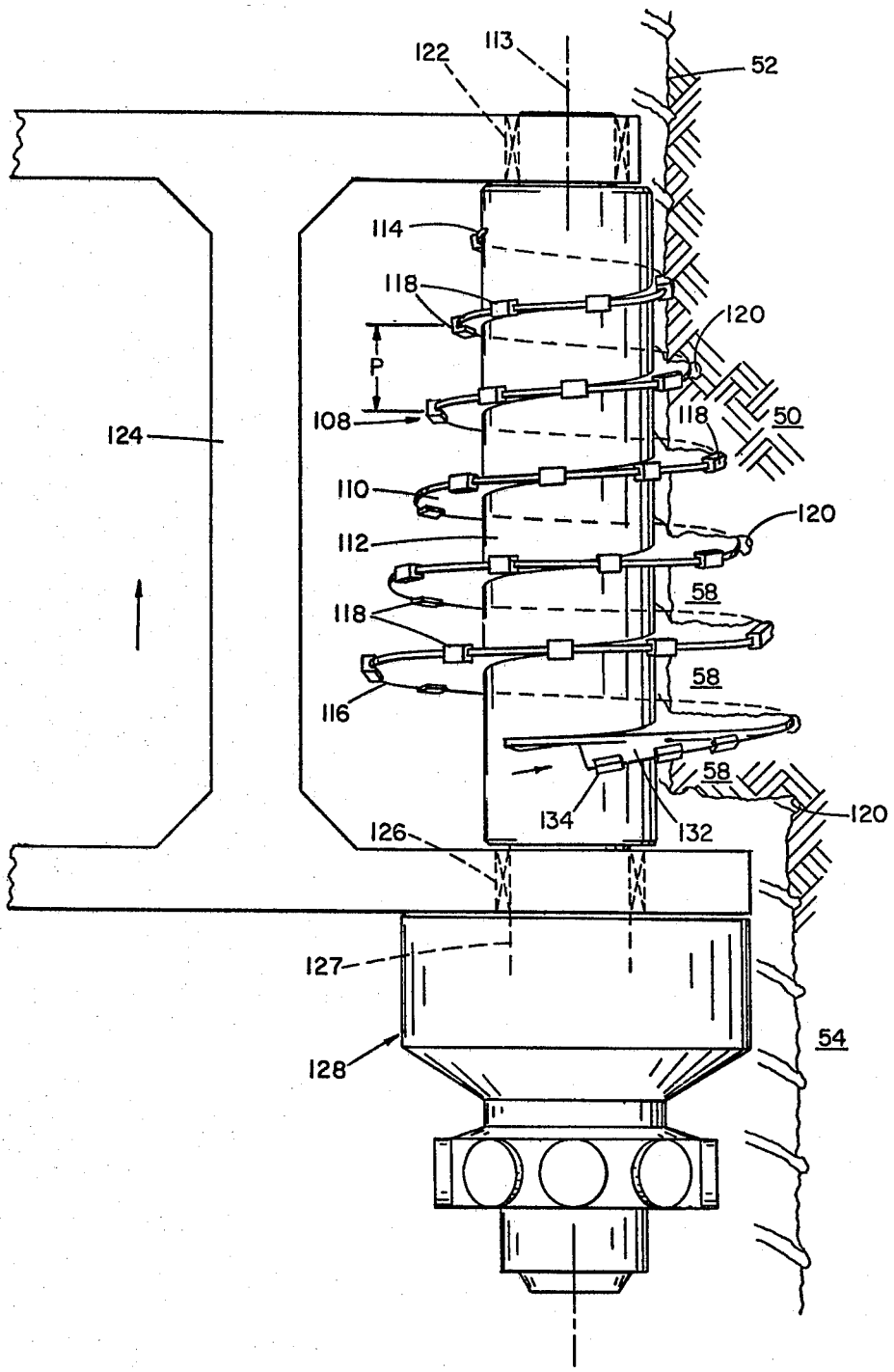
FIG. 1 is a partially schematic top view with the material being excavated shown in section.

The basic mining element is a screw-like, tapered saw as illustrated in FIG. 1. The spiral saw assembly 108 consists of a bit carrier in the form of a three-dimensional spiral web 110 of constant pitch P mounted on a central cylindrical core 112. The outer radius of web 110 increases monotonically from the leading end 114 to a maximum at 116 near the trailing end, and from that point rearward the web radius remains constant. The outer edge of web 110 is equipped with a plurality of cutter bits or teeth 118 arranged to cut into the rock 50. Teeth 118 are wider than the thickness of web 110 (in the direction transverse to the instantaneous direction of the movement of the bits in operation) and thus cut spiral slot 120, wider than web 110 in rock 50 so that upon rotation of core 112 and web 110, the latter does not rub against the sides of slot 120. In operation the assembly 108 advances parallel to core axis 113 exactly one pitch P for each revolution. As illustrated in FIG. 1, assembly 108 engages rock 50 along one side only and although slot 120 appears to be several slots, it is actually segments of a single slot, like a screw thread, which has been interrupted by the absence of rock on the opposite side of assembly 108.

Core 112 is at its forward end supported for rotation by bearing 122 in frame 124, and at its rearward end by bearing 126, also in frame 124. Rearward shaft extension 127 extends through bearing 126 to be driven by motorized drive assembly 128 (e.g., hydraulic, using fluid supplied through suitable hoses, not shown) attached to frame 124.

Teeth 118 cut spaced sections of slot 120, leaving therebetween rock webs 58 which, because carrier web 110 is relieved all the way to core 112, extend into the spaces between the carrier turns all along the spiral. Cylindrical section 130 of assembly 108 is arranged to break out these "quarter moon" shaped webs. In one configuration (FIGS. 1, 4) the cylindrical extension of web 110 is equipped with a rearward extending wedge-shaped protrusion 132 which in turn is tipped with teeth 134. Upon rotation of core 112 and web 110, protrusion 132 enters slot 120, cutting and wedging rearwardly into rock web 58, with the result that a crack 60 appears, and rock web 58 breaks off, creating new rock surface 54.

FIG. 5, illustrates an alternate construction for excavating weak material such as coal: a simple wedge 136 is shown without teeth. Fig. 6 illustrates still another construction: a cylindrical (i.e., not wedge section like 132) saw 138 equipped with teeth 139 for sawing out rock web 58 and, optionally, a ramp surface 140 on web 110 to assist by bending rock web 58 to the rear.

FIG. 7 shows in detail an individual cutter tooth 118 and the adjacent local portion of web 110. The instantaneous path of the tooth 118 is shown as the sides 120' and 120'' of slot 120 illustrated in previous Figures. As shown in FIG. *7a*, a development of the motion of a single tooth 118 during one revolution of the spiral saw assembly 108 consists of a component P (the screw pitch) in the direction of the assembly axis 113, and a circumferential component equal to $2\pi R$, where $R$ is the local radius from axis 113 to the tip of the tooth 118.

The resultant motion describes a helix at angle $\theta$ with the tangential direction where $$\tan \theta = \frac{P}{2\pi R}$$

For example, for a tooth at the rear of a 2-foot radius unit having a 6-inch pitch, the helix angle would be $$\tan \theta_2 = \frac{.5}{2 \times 3.14 \times 2}$$
$$\theta_2 = 2.3°$$

For another tooth further forward on the same unit, say at a radius of 1-foot, the local helix angle would be $$\tan \theta_1 = \frac{.5}{2 \times 3.14 \times 1}$$
$$\theta_1 = 4.5°$$

Note that, whatever the local radius R, the pitch P is the same for all teeth on a given unit; hence helix angle $\theta$ varies with radius.

Returning to FIG. 7 a "square" tooth having a face 119 at 90° to the instantaneous tooth path is illustrated. FIG. 8 shows the side of tooth 118 and web 110. Line 120''' indicates the constant radius depth of groove 120 produced by this particular tooth 118 as the assembly rotates about (and advances along) axis 113. Note that the groove depth 120'''' ahead of this tooth left by a preceding tooth at lesser radius, is less and that the illustrated tooth increases the groove 120 depth by a constant increment $\delta$, in saw-like fashion. FIG. 10 also illustrates a tooth "rake angle" $\alpha$ (which is illustrated in the conventional "positive" form but which may advantageously be "negative" for some materials) and "relief angle" $\beta$, both in keeping with conventional practice (and to avoid interference with curved surface 120'''').

The motion of the square tooth 118 in the helical direction is resisted by force F which is generated by the material (of thickness $\delta$) removed by this tooth. In general, for a square tooth as illustrated (or for any other tooth form symmetric about the tooth central plane 121), the force F will be parallel to and opposite to the direction of instantaneous motion of tooth 118. In particular, this resistive force F will have a rearward axially directed component which must be overcome by the mechanism driving the tooth 118. For the plurality of teeth 118 in contact with the rock, then, a net forward force must be provided to propel assembly 108 forward as it rotates. This force may come from an external source such as a tractive vehicle carrying assembly, or it may arise locally as the rearward flank 123 of tooth 118 rubs against and follows the side 120' groove 120. This latter operation, however, would cause excessive wear of tooth flank 123, and it would consume excessive power.

FIG. 9 illustrates a tooth 118' having a face 119' which is skewed at angle $\phi$ (opening in the direction of advance along axis 113) relative to the "square tooth" (i.e., relative to a line perpendicular to the instantaneous direction of tooth motion). In this case, resistance F' being at roughly 90° to face 119', has a forward component if skew angle $\phi$ is greater than the local helix angle $\theta$. Thus a skewed tooth face can be used to provide an axial propelling force component, avoiding both an external means, such as a tractive vehicle, or rubbing against the flank of the tool. Since $\theta$ varies with tooth radial position, a practical design may use a $\phi$ value that is greater than the maximum $\theta$, thus providing an excess forward force component (and resulting in rubbing on the tooth forward flank) or, preferably, a $\phi$ value that is greater than the mean $\theta$ value for all the teeth.

Preferably both pitch P and the radial distance between the cylindrical surface of core 112 and the cutting edge of tooth 118 at the maximum radius portion of web 110, are at least 3 times and most preferably at least 5 times as great as the width of teeth 118 in the direction transverse to the instantaneous direction of tooth motion in operation. Thus, well over two-thirds of the excavated material will be broken off in large chunks rather than being directly sawed by the teeth.

Figure 2:
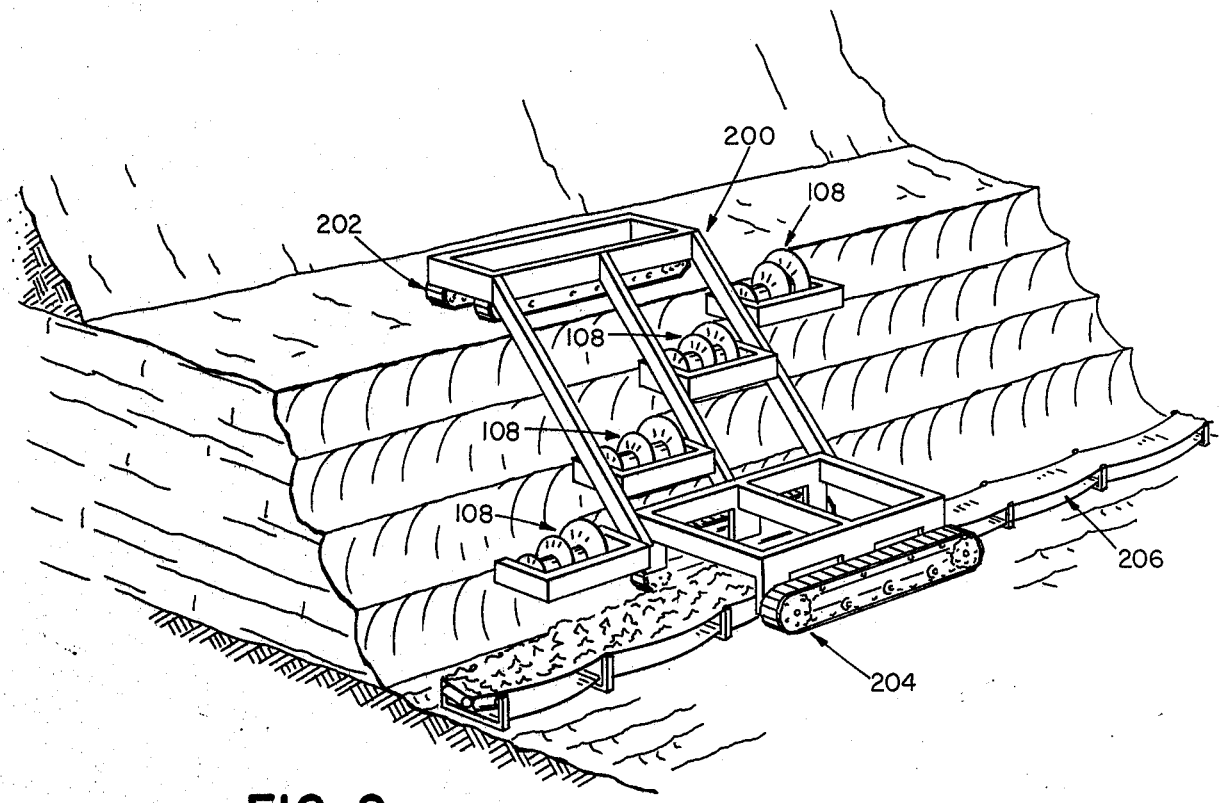
FIG. 2 is an end view of an assembly of four of the elements of FIG. 1 embodying the invention.
Figure 3:
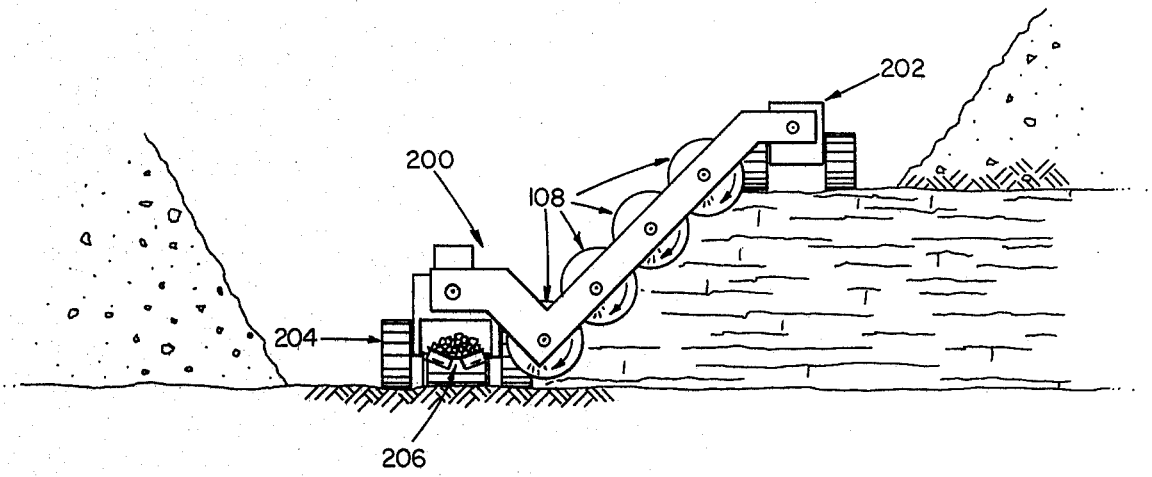
FIG. 3 is a perspective view of the assembly of FIG. 2.

FIGS. 2 and 3 show four elements 108, each with their individual frame 124 and drive (not shown) arranged in a common framework 200 according to the invention, to excavate on the sloped face of an exposed coal seam. The horizontal offset from screw to screw, with all screws rotating in the same direction (clockwise when viewed axially with the slope extending upwardly to the right) as shown, provides the necessary horizontal force to crowd the vehicle against the face, while the weight of the machinery holds it down. The self-advancing screws of course require no force in the traverse direction, although traverse would in all probability be controlled by ordinary traction means via the support vehicles 202 and 204 at the top and bottom of the screw assembly.

Each screw is mounted to the rear of the one immediately below in the assembly. This permits identical screw elements (i.e., all of the same "hand") to rotate in the same direction without clashing, and it also permits cuttings from each screw to fall freely down the face without interfering with the lower screw elements.

Seams of widenly differing thickness can be accomodated by varying the number of screws in an assembly while retaining the convenience and economy of a single standardized screw element design. Variations in seam thickness along the length of a single pit are easily accomodated by simply allowing the angle of the face slope to vary as necessary. Note also that, within reason, curved pit plans would present no problems.

A conveyor 206 extends the length of the pit along the base of the coal face. Coal either falls onto or is directed onto this conveyor, thence out to the end of the pit to another conveyor that delivers coal from the pit. The face conveyor is moved laterally as the face recedes, as in longwall mining.

The arrangement shown advantageously permits an extremely narrow pit floor. The minimum possible floor width would be that required by the lower support vehicle, although it would probably be advisable to leave a slightly wider floor to permit access by maintenance vehicles alongside the conveyor.

As is apparent, the above arrangement could be used to simultaneously excavate the opposing sloping forces of the shaped pit, by mounting separately sloping assemblies of screw elements side by side on a common framework.

Other embodiments are within the following claims.

What is claimed is:

1. In a drag bit excavating device having a plurality of cutting elements, each said element comprising a core extending along an axis, a bit carrier supported on said core, cutter bits supported by said carrier along a three dimensional spiral having constant pitch and increasing radius along at least a portion of said axis, said carrier being relieved to provide radially extending spaces between the turns of said spiral, a frame supporting said core, carrier, and bits for rotation about and advance parallel to said axis, and, a drive to provide said rotation, whereby said bits slot the material to be excavated while said material between portions of the resulting slot extends into said spaces to be subsequently broken away, that improvement comprising support means for supporting said elements in an array sloping along a plane with their respective said axes parallel to each other, said plane sloping in a direction transverse to said axes, said axes being spaced along said plane in said direction of slope, said elements having their drives arranged so that each core, carrier, and bit assembly rotates clockwise when viewed along its axis with said plane sloping upwardly toward the right.

2. The device of claim 1 wherein said elements are staggered along the direction of said axes so that cuttings produced by one element do not drop on another element.

3. The device of claim 1 further comprising upper and lower support vehicles at the upper and lower ends of said support means.

* * * * *